US011065497B2

(12) United States Patent
Liu

(10) Patent No.: US 11,065,497 B2
(45) Date of Patent: Jul. 20, 2021

(54) KETTLE-SHAPED PLASTIC STEEL DUMBBELL

(71) Applicant: OHFG TECHNOLOGIES (SHANGHAI) CO., LTD., Shanghai (CN)

(72) Inventor: Ping Liu, Shanghai (CN)

(73) Assignee: OHFG TECHNOLOGIES (SHANGHAI) CO., LTD., Shanghai (CN)

( * ) Notice: Subject to any disclaimer, the term of this patent is extended or adjusted under 35 U.S.C. 154(b) by 90 days.

(21) Appl. No.: 16/693,229

(22) Filed: Nov. 23, 2019

(65) Prior Publication Data

US 2021/0154518 A1 May 27, 2021

(51) Int. Cl.
*A63B 21/072* (2006.01)
*A63B 21/00* (2006.01)

(52) U.S. Cl.
CPC ..... *A63B 21/072* (2013.01); *A63B 21/0724* (2013.01); *A63B 21/0726* (2013.01); *A63B 21/4033* (2015.10); *A63B 21/4035* (2015.10)

(58) Field of Classification Search
None
See application file for complete search history.

(56) References Cited

U.S. PATENT DOCUMENTS 9,079,070 B2 * 7/2015 Reynolds ..... A63B 21/072
10,420,978 B2 * 9/2019 Wang ..... A63B 21/075
2010/0210427 A1 * 8/2010 Yu ..... A63B 21/075 482/93
2013/0040789 A1 * 2/2013 Kessler ..... A63B 21/072 482/108
2013/0157814 A1 * 6/2013 Nowicki ..... A63B 21/4049 482/93
2014/0274614 A1 * 9/2014 Newman ..... A63B 21/4035 482/139
2017/0259106 A1 * 9/2017 Pawlas ..... A63B 21/4035
2019/0240526 A1 * 8/2019 Owusu ..... A63B 21/00065
2019/0344113 A1 * 11/2019 Tran ..... A63B 21/075
2020/0114204 A1 * 4/2020 Owusu ..... A63B 21/075

* cited by examiner

*Primary Examiner* — Joshua Lee
(74) *Attorney, Agent, or Firm* — Zhu Lehnhoff LLP

(57) ABSTRACT

A kettle-shaped plastic steel dumbbell comprises a kettle-shaped dumbbell piece and a dumbbell shell molded by injection at the exterior of the dumbbell piece; a handle is fixed on the exterior of the dumbbell shell; a corner sleeve is placed at the joint of the dumbbell shell and the handle; the exterior of the top part of the handle is covered by an anti-slip sleeve; the exterior of the dumbbell piece is covered by a smooth plastic rubber shell, preventing rusts on the dumbbell piece surface overtime which could fall off and damage indoor environment, and avoiding burrs of dumbbell piece surface from puncturing users; anti-slip sleeve with corrugated drain slots is installed on the handle which channels sweat towards both ends of the handle, preventing sweat accumulation from reducing gripping friction and therefore reducing the risk of kettle-shaped dumbbell falling; an elastic component is installed at the bottom of the dumbbell shell to prevent the gravity of the kettle-shaped dumbbell from damaging the ground when being placed.

7 Claims, 3 Drawing Sheets

KETTLE-SHAPED PLASTIC STEEL DUMBBELL

FIELD OF THE INVENTION

The invention relates to the technical field of sports equipment, in particular a kettle-shaped plastic steel dumbbell.

BACKGROUND OF THE INVENTION

Dumbbell is a piece of equipment used in muscle strength training. It is named as a dumbbell due to its silent nature in training. It can be used for muscle strength training and muscle compound movement training. Dumbbells can help patients with low muscle strength derived from paralysis, pain, long-term sedentary lifestyle, etc., to train muscle strength with active counter-resistance weight training.

Technical problems existing in prior arts:

1. The weight structure of the existing kettle-shaped dumbbell is directly die-casted with no protective sleeve for the exterior of the dumbbell piece. The result of which is that rust may occur on the surface over time, causing the surface to fall off and damaging indoor environment, and the rough exterior may also puncture users;

2. The existing kettle-shaped dumbbell has no anti-slip sleeve at the handle, users could easily drop the dumbbell because of sweat that reduces gripping friction;

In order to solve the above-mentioned problems, a kettle-shaped plastic steel dumbbell is proposed in the present application.

SUMMARY OF THE INVENTION

(I) Purpose of the Invention

The invention proposes a kettle-shaped plastic steel dumbbell in order to solve the technical problems existing in the previous arts. According to the invention, the dumbbell shell is covered by plastic rubber on the exterior of the dumbbell piece which has smooth surface to prevent the dumbbell piece from rusting over time. The plastic rubber not only prevents the exterior of the dumbbell piece from falling off and damaging indoor environment, but also metal burrs on the exterior of the dumbbell piece from puncturing users. In addition, anti-slip sleeve with corrugated drain slots is installed on the handle which channels sweat towards both ends of the handle, preventing sweat accumulation from reducing gripping friction and therefore reducing the risk of kettle-shaped dumbbell falling.

(II) Technical Scheme

In order to solve the above problems, the invention provides a kettle-shaped plastic steel dumbbell, which comprises a kettle-shaped dumbbell piece and a dumbbell shell molded by injection on the exterior of the dumbbell piece;

A handle is fixed on an exterior of the dumbbell shell, a corner sleeve is placed at a joint of the dumbbell shell and the handle, the exterior of the top part of the handle is covered by an anti-slip sleeve with corrugated drain slots.

Best mode, the above-stated dumbbell shell is a plastic rubber component.

Best mode, the above-stated dumbbell includes mineral sand with a diameter of 0-0.5 mm, steel balls with a diameter of 0-0.5 mm and plastic steel epoxy.

Best mode, the above-stated dumbbell handle is a cold-rolled seamless tube component.

Best mode, both ends of the above-stated dumbbell handle are symmetrically installed at both ends of the upper half of the dumbbell shell, and one end of the handle which penetrates into one end of the dumbbell shell is embedded into the inside of the dumbbell piece;

Best mode, the above-stated dumbbell shell has a nameplate fixed on its front surface.

Best mode, the above-stated dumbbell shell has an elastic component installed at its bottom.

The technical scheme of the invention has the following advantages:

1. The exterior of the dumbbell piece is covered by a smooth plastic rubber shell, preventing rusts on the dumbbell piece surface overtime which could fall off and damage indoor environment, and avoiding burrs of dumbbell piece surface from puncturing users;

2. Anti-slip sleeve with corrugated drain slots is installed on the handle which channels sweat towards both ends of the handle, preventing sweat accumulation from reducing gripping friction and therefore reducing the risk of kettle-shaped dumbbell falling;

3. An elastic component is installed at the bottom of the dumbbell shell to prevent the gravity of the kettle-shaped dumbbell from damaging the ground when being placed.

KEYS

1. Dumbbell shell; 2. Handle; 3. Corner sleeve; 4. Nameplate; 5. Elastic component; 6. Dumbbell piece; 7. Anti-slip sleeve; 8. Drain slots.

DETAILED DESCRIPTION OF THE PREFERRED EMBODIMENTS

To present a clearer view of the purpose, technical scheme and advantages of this invention, the following description will have a further explanation with preferred embodiments and drawings reference combined. It should be noted that the description is only illustrative, rather than limiting the application scope of the invention. Additionally, known structures and technologies are omit in the following description to avoid unnecessarily confusion of the invention concept.

Figure 1:
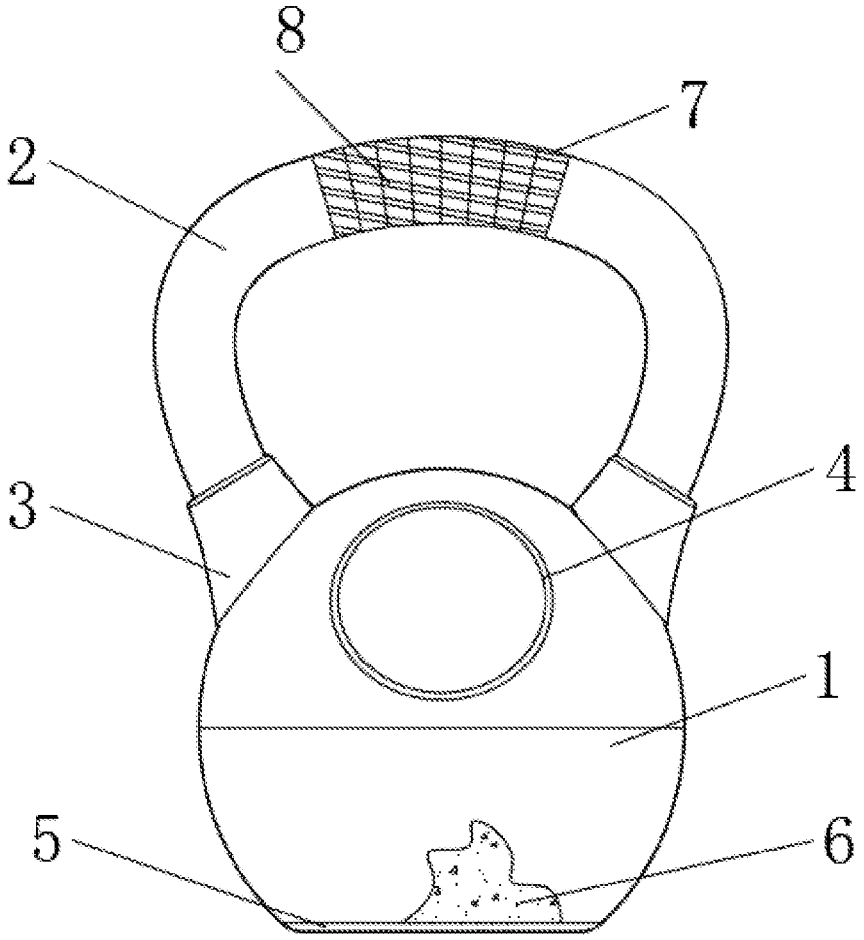
FIG. 1 is a structure diagram of the kettle-shaped plastic steel dumbbell proposed by the invention.
Figure 2:
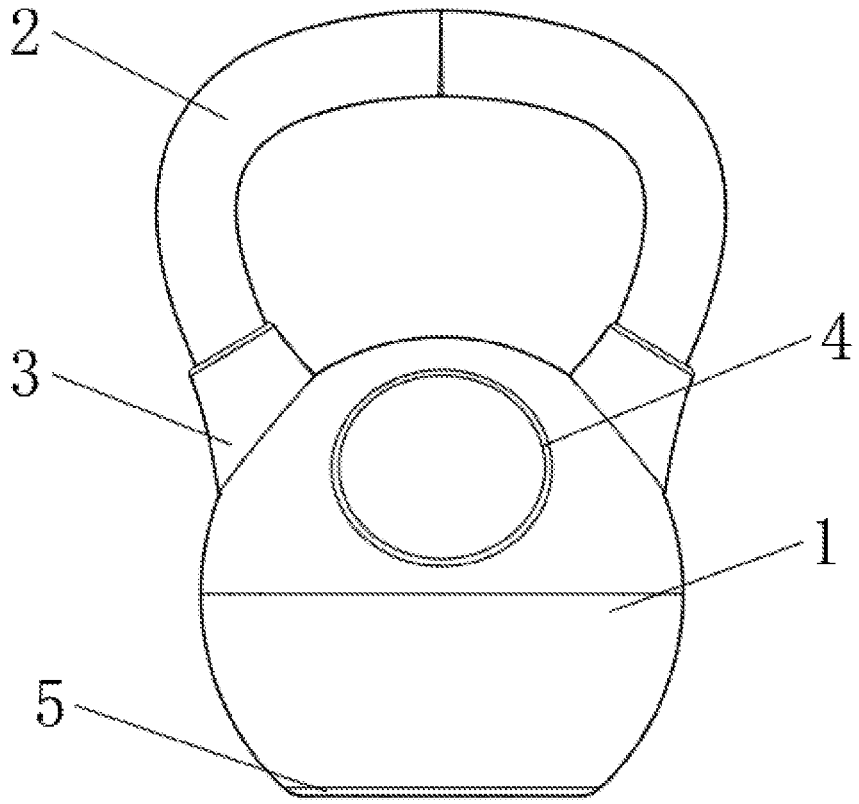
FIG. 2 is a front-view structure diagram of the kettle-shaped plastic steel dumbbell proposed by the invention.
Figure 3:
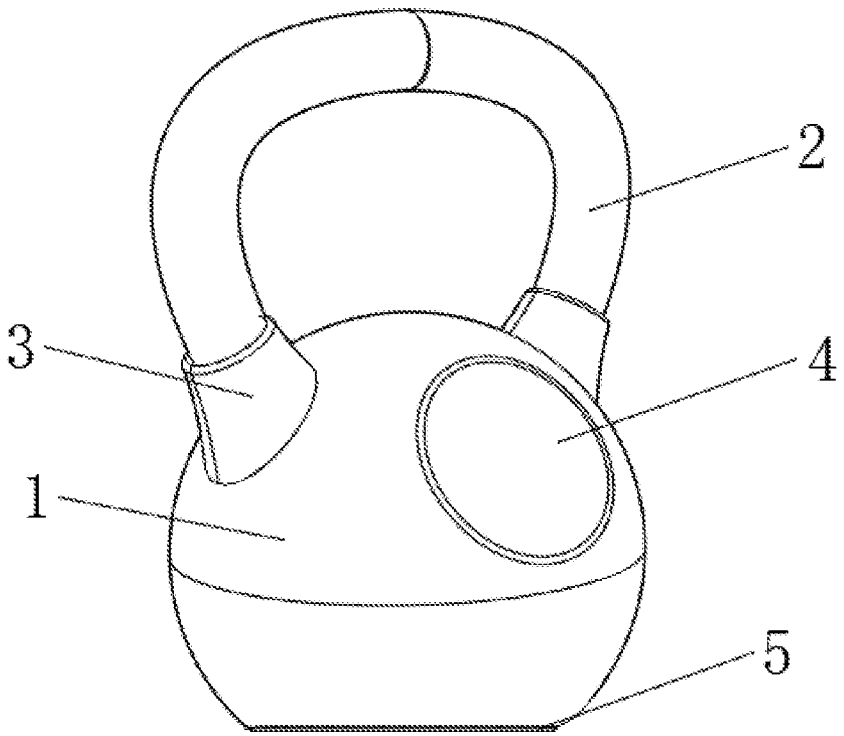
FIG. 3 is a three-dimensional structure diagram of the kettle-shaped plastic steel dumbbell proposed by the invention.

As shown in FIGS. 1-3, a kettle-shaped plastic steel dumbbell proposed by the invention comprises a kettle-shaped dumbbell piece 6 and a dumbbell shell 1 molded by injection on the exterior of the dumbbell piece 6; a handle 2 is fixed on the exterior of the dumbbell shell 1, a corner sleeve 3 is placed at the joint of the dumbbell shell 1 and the handle 2, and the corner sleeve 3 covers the joint of handle 2 and dumbbell shell 1 to maintain overall sealing.

It should be noted that:

1. The dumbbell shell 1 is a plastic rubber component covering the exterior of the dumbbell piece 6 for protection using injection mold;

2. The dumbbell piece 6 comprises mineral sand with a diameter of 0-0.5 mm, steel balls with a diameter of 0-0.5 mm and plastic steel epoxy. The dumbbell piece 6 is made of the above materials by die casting to create a counterweight, and the material input is subject to adjustments according to the technological requirements for die casting dumbbells of different weights;

3. Handle 2 is a cold-rolled seamless tube component. The cold-rolled seamless tube member is bent to form a structure similar to "cow horn"; both ends of the handle 2 that penetrate into both ends of the dumbbell shell 1 are imbedded into the inside of the dumbbell piece 6, and the dumbbell piece 6 covers the handle 2 to form the basic structure of the kettle-shaped dumbbell.

In an optional embodiment, a nameplate 4 is fixed on the front surface of the dumbbell shell 1, and the actual weight indication is engraved on the nameplate 4 according to the actual weight specification of the kettle-shaped dumbbell.

In an optional embodiment, an elastic component 5 is installed at the bottom of the dumbbell shell 1: The elastic component 5 is a thermoplastic elastomer with styrene-block-copolymers. The elasticity of styrenic thermoplastic elastomers is exceptionally high and does not change with the relative molecular mass. Styrenic thermoplastic elastomers, with the characteristics of high-strength, softness, rubber elasticity and low risk of permanent deformation, can prevent gravity damage to the ground when the dumbbell is being placed.

In the invention, both ends of the handle 2 penetrate into the inside of the dumbbell piece 6 for casting in an integrative molding, and the dumbbell shell 1 molded by injection on the exterior of the formed kettle-shaped dumbbell is used for covering protection. The dumbbell shell 1 has a smooth exterior to prevent the internal dumbbell piece 6 from rusting over time. The dumbbell shell can not only prevent the exterior of the dumbbell piece 6 from falling off and damaging indoor environment, but also prevent burrs on the exterior of the dumbbell piece 6 from puncturing users.

FIG. 1 is a structure diagram of the plastic steel kettle-shaped dumbbell proposed by the invention.

As shown in FIG. 1, an anti-slip sleeve 7 is placed on the exterior at the top of the handle 2, and corrugated drain slots 8 are formed on the anti-slip sleeve 7.

It should be noted that the anti-slip sleeve 7 with drain slots 8 is installed on the handle 2. When a user lifts the kettle-shaped dumbbell while holding the anti-slip sleeve 7 for exercise, sweat from the hand adheres to the exterior of the anti-slip sleeve 7, and the corrugated drain slots 8 dredge the sweat along the anti-slip sleeve 7 toward both ends of the handle 2 to prevent sweat accumulation on the anti-slip sleeve 7 of the handle 2 from reducing grip gripping friction and to reduce the hidden danger of the dumbbell slipping out of the hand.

It should be understood that the above detailed description of the preferred embodiments of the invention is only used for illustrating or explaining the principle of the invention, rather than constituting a limitation on the invention. Therefore, any modification, equivalent replacement, improvement and the like made without deviating from the spirit and scope of the invention shall be included in the protection scope of the invention. Moreover, the appended claims of the invention are intended to cover all changes and modifications that fall within the scope and boundary of the appended claims or the equivalent form of such scope and boundary.

The invention claimed is:

1. A kettle-shaped plastic steel dumbbell, comprising:

a kettle-shaped dumbbell piece (6);

a dumbbell shell (1) molded by injection at an exterior of the dumbbell piece (6);

a handle (2) being fixed on an exterior of the dumbbell shell (1); and a corner sleeve (3) being placed at a joint of the dumbbell shell (1) and the handle (2), an exterior of a top part of the handle (2) being covered by an anti-slip sleeve (7) with corrugated drain slots (8).

2. The kettle-shaped plastic steel dumbbell according to claim 1, wherein the dumbbell shell (1) is a plastic rubber component.

3. The kettle-shaped plastic steel dumbbell according to claim 1, wherein the dumbbell piece (6) comprises mineral sand with a diameter of 0-0.5 mm, steel balls with a diameter of 0-0.5 mm and plastic steel epoxy.

4. The kettle-shaped plastic steel dumbbell according to claim 1, wherein the handle (2) is a cold-rolled seamless tube component.

5. The kettle-shaped plastic steel dumbbell according to claim 1, wherein both ends of the handle (2) are symmetrically installed at both ends of the upper half of the dumbbell shell (1), and one end of the handle (2) which penetrates into one end of the dumbbell shell (1) is embedded into a inside of the dumbbell piece (6).

6. The kettle-shaped plastic steel dumbbell according to claim 1, wherein a nameplate (4) is fixed on a front surface of the dumbbell shell (1).

7. The kettle-shaped plastic steel dumbbell according to claim 1, wherein an elastic component (5) is installed at a bottom of the dumbbell shell (1).

* * * * *